US011208827B2

(12) United States Patent
Long

(10) Patent No.: US 11,208,827 B2
(45) Date of Patent: Dec. 28, 2021

(54) TENT

(71) Applicant: Oztent Australia Pty. Limited, Wetherill Park (AU)

(72) Inventor: Peter Long, Wetherill Park (AU)

(73) Assignee: Oztent Australia Pty. Limited, Wetherill Park (AU)

( * ) Notice: Subject to any disclaimer, the term of this patent is extended or adjusted under 35 U.S.C. 154(b) by 0 days.

(21) Appl. No.: 16/625,989

(22) PCT Filed: Jun. 22, 2018

(86) PCT No.: PCT/AU2018/000104
§ 371 (c)(1),
(2) Date: Dec. 23, 2019

(87) PCT Pub. No.: WO2018/232440
PCT Pub. Date: Dec. 27, 2018

(65) Prior Publication Data

US 2020/0165837 A1 May 28, 2020

(30) Foreign Application Priority Data

Jun. 23, 2017 (AU) ..... 2017902422

(51) Int. Cl.
*E04H 15/46* (2006.01)
*E04H 15/48* (2006.01)
*E04H 15/38* (2006.01)

(52) U.S. Cl.
CPC ..... *E04H 15/46* (2013.01); *E04H 15/38* (2013.01); *E04H 15/48* (2013.01)

(58) Field of Classification Search
CPC ..... E04H 15/38; E04H 15/48; E04H 15/46
See application file for complete search history.

(56) References Cited

U.S. PATENT DOCUMENTS 4,069,833 A * 1/1978 Johansson ..... E04H 15/003 135/130
4,355,650 A * 10/1982 Beaudry ..... E04H 15/38 135/118

(Continued)

FOREIGN PATENT DOCUMENTS

| | | |
|---|---|---|
| GB | 1313155 | 4/1973 |
| WO | WO 2011/047430 | 4/2011 |
| WO | WO 2012/065226 | 5/2012 |

OTHER PUBLICATIONS

International Search Report for PCT/AU2018/000104 dated Aug. 30, 2018, 3 pages.

*Primary Examiner* — David R Dunn
*Assistant Examiner* — Danielle Jackson
(74) *Attorney, Agent, or Firm* — Dority & Manning, P.A.

(57) ABSTRACT

A tent having a frame (1), the frame (1) having a plurality of sub-frames (3*a-c*); each said sub-frame (3*a-c*) having a pair of elongate side members (5*a-c*) connected by an elongate cross member (35*a-c*), a first free end (4*a-c*), and a second free end (6*a-c*); a first foot (10) coupled to each of said first free ends (4*a-c*) of said sub-frames (3*a-c*); a second foot (10) coupled to each of said second free ends (6*a-c*) of said sub-frames (3*a-c*); each foot (10) adapted to permit movement of said sub-frames (3*a-c*) with respect to each other, and each foot (10) adapted to be placed on a surface to support said frame (1) in use; one sub-frame (3*c*) adapted to be located in use on a ground surface, a locking mechanism (2) locatable on a second sub-frame (3*b*) and adapted in use to slide along said side member (5*b*) of said second sub-frame (3*b*) to lock in place a support member (30*a, b*) extendable in use from said one sub-frame (3*c*).

18 Claims, 9 Drawing Sheets

(56) References Cited

U.S. PATENT DOCUMENTS

| | | | | |
|---|---|---|---|---|
| 4,612,948 | A * | 9/1986 | Simpson | E04H 15/001 135/117 |
| 4,748,995 | A | 6/1988 | Viglione | |
| 4,884,589 | A * | 12/1989 | Simpson | E04H 15/001 135/117 |
| 6,209,558 | B1 * | 4/2001 | Viglione | E04H 15/48 135/132 |
| 7,938,134 | B2 * | 5/2011 | Adams | E04H 15/38 135/124 |
| 9,506,269 | B2 * | 11/2016 | Armstrong | E04H 15/06 |
| 2006/0169311 | A1 * | 8/2006 | Hwang | E04H 15/50 135/142 |
| 2015/0308146 | A1 | 10/2015 | Mercieca et al. | |
| 2017/0009803 | A1 * | 1/2017 | Parsons | E04H 15/001 |

* cited by examiner

TENT

PRIORITY CLAIM

This application is based upon and claims the right of priority under 35 U.S.C. § 371 to International Application No. PCT/AU2018/000104 filed on Jun. 22, 2018, which claims the benefit of AU Application Serial No. 2017902422 filed Jun. 23, 2017. Applicant claims priority to and the benefit of each of such applications and incorporates all such applications herein by reference in their entirety.

FIELD

The present invention relates to camping and outdoor products and in particular to a tent and associated equipment.

BACKGROUND

Tents and camping equipment come in all different shapes and sizes. With respect to tents, there is often a need for a tent that is more compact when folded, easier and faster to erect and more sturdy in high winds. One way of achieving this is with a self-locking slider, quick release foot, and/or modular fold out tent telescopic extrusions.

The disadvantages of current tents having non-locking sliders are that they require users to stretch across and push the slider into a fixed position whilst holding up the tent frame in some cases requiring two or more people to do this function. Further, even when the slider is in the fixed position it is not locked in place and can easily be bumped causing the tent to collapse. This is of particular concern when erecting a tent in the rain, wind or at night. Further, current foot mechanisms cannot be easily repaired as they are either riveted and/or bolted together. This makes them generally inconvenient to a user who might have to replace the entire tent at cost if they are damaged. There are also limitations in the size of current fold out tents in that they can be too small for many customers or if additional people suddenly want to stay over and visit. The current tent extrusions also limit the overall height of the tent in that they do not provide a full height tent for most customers. There are also issues with the packing size of current fold out tents in that the length of the main extrusion determines the length of the bag thus having a fixed and lengthy extrusion can result in the need to use a long bag that simply won't fit in the back of most vehicles requiring the bag to be mounted on roof racks on the roof of the vehicle.

OBJECT OF THE INVENTION

It is an object of the present invention to substantially overcome or at least ameliorate one or more of the disadvantages of the prior art, or to at least provide a useful alternative.

SUMMARY OF INVENTION

There is disclosed herein a tent having a frame, the frame having:

a plurality of sub-frames;

each said sub-frame having a pair of elongate side members connected by an elongate cross member, a first free end, and a second free end;

a first foot coupled to each of said first free ends of said sub-frames;

a second foot coupled to each of said second free ends of said sub-frames;

each foot adapted to permit movement of said sub-frames with respect to each other, and each foot adapted to be placed on a surface to support said frame in use;

one sub-frame adapted to be located in use on a ground surface, a locking mechanism locatable on a second sub-frame and adapted in use to slide along said side members of said second sub-frame to lock in place a support member extendable in use from said one sub-frame.

Preferably, said sub-frames are n-shaped.

Preferably, said side members are telescopically extendable members.

Preferably, the frame includes telescopically extendable cross members to provide stability between said sub-frames.

Preferably, the frame in an opened configuration is adapted to hold a tent cover fixed to said frame by fasteners.

Preferably, said side and cross members are adapted to fold so that said side and cross members are substantially parallel to each other when the frame is in the closed configuration.

Preferably, said side members and cross member are connected by a hinge adapted to permit said side members and cross members in the opened configuration to be placed at right angles to each other and in the closed configuration to be locatable substantially parallel to each other.

Preferably, the frame in use is modular and adapted to connect to other frames on each side to extend a useable surface area.

Preferably, the locking mechanism includes a slider, the slider having a pin adapted in use to lock into said side member of said second sub-frame.

Preferably, the slider includes a quick release button.

Preferably, in use one or more of said sub-frames can be rotated away from the sub-frame located in use on the ground surface to increase a volume of said tent.

Preferably, the frame includes extension members to support an enclosure as said sub-frames are rotated away from said sub-frame located in use on the ground surface.

Preferably, each foot of the frame is removably coupled to said frame.

Preferably, each foot comprises a pair of sides and a base extending between said pair of sides, each side member of said sub-frame adapted to be located in use on the ground surface is coupled to said base of a respective one of said feet, and each side member of the other sub-frames is coupled to said pair of sides of a respective one of said feet.

Preferably, each side member is located between said pair of sides of a respective one of said feet.

BRIEF DESCRIPTION OF DRAWINGS

A preferred embodiment of the invention will now be described, by way of example only, with reference to the accompanying drawings, wherein.

DESCRIPTION OF EMBODIMENTS

Figure 1:
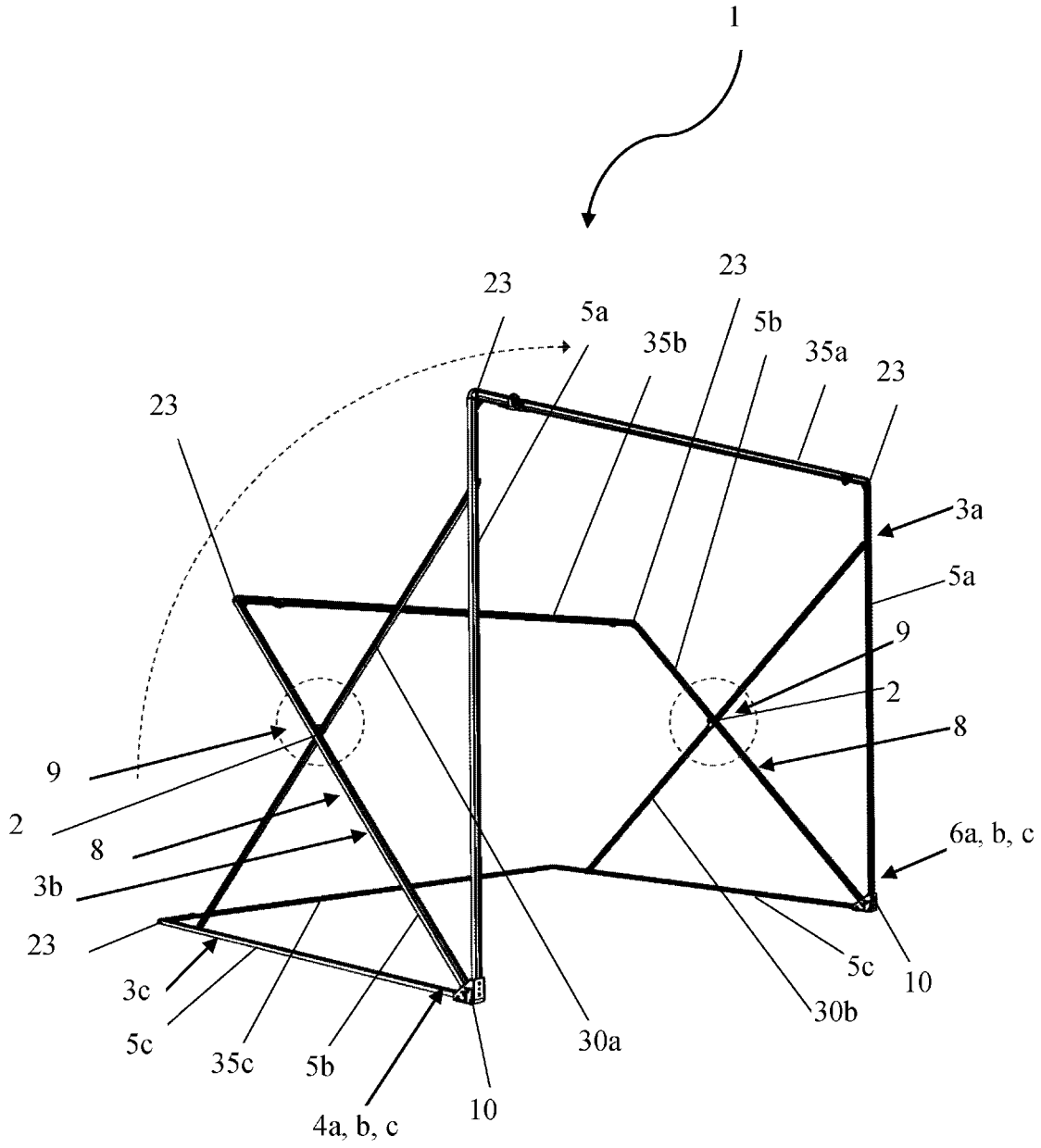
FIG. 1 is a perspective view of a tent frame according to an embodiment of the present invention.

FIG. 1 shows a tent frame 1 of an embodiment of the present invention. The frame 1 includes locking mechanisms in the form of self-locking sliders 2 and a series of n-shaped sub-frames 3*a-c*. Each sub frame 3*a-c* has respective elongate side member 5*a-c*, a respective elongate cross member 35*a-c* to provide stability to the respective sub-frames 3*a-c*, a respective first free end 4*a-c*, and a respective second free end 6*a-c*. Each sub frame 3*a-c* is adapted to rotate between an open configuration (see FIG. 1) and a closed configuration (see FIG. 10). It is envisaged that each of the side members 5*a-c* and each of the cross members 35*a-c* are telescopically extendable/retractable members. It is also envisaged that each telescopically extendable/retractable member may comprise spring loaded push pins that are capable of locking a respective member at multiple lengths, thereby allowing each member to be set to different lengths depending on the needs of a user at any one time. Push button, wing-nut screws, or the like may also be used to lock each of the telescopically extendable/retractable members at a desired length.

Each of the side members 5*a-c* and each of the cross members 35*a-c* are adapted to fold such that each of the side members 5*a-c* and each of the cross members 35*a-c* are substantially parallel to each other when the frame is in the closed configuration. In the open configuration, the frame 1 is adapted to support a tent cover roof, walls, and sides (i.e. an enclosure). The cover being fixed to the frame 1 by fasteners (not shown). It will be appreciated that the sub-frames 3*a* and 3*b* are rotatable away from the sub frame 3*c* (i.e. the base sub frame) to increase the volume of the tent.

Figure 2:
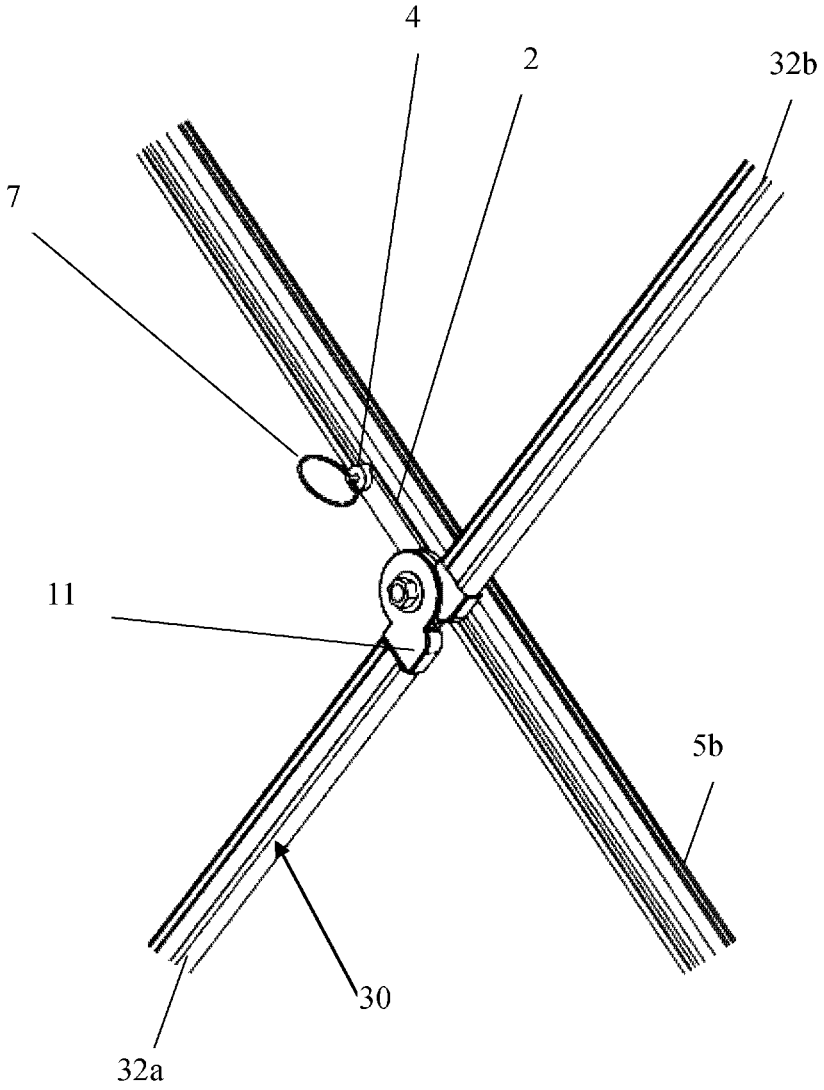
FIG. 2 is an enlarged partial view of the tent from of FIG. 1.

Each slider 2 is adapted to slide along one of the side members 5*b* of the tent frame 1. Referring to FIG. 2, each slider 2 has a pin 4 that can lock into a respective one of the side members 5*b* at one, two or more locations. Referring to FIG. 1, the pin 4 of each slider 2 locks into position one (Stop Position 8) along a respective one of the side members 5*b* when the frame 1 is in the open configuration and each slider 2 can then be slid into position two (Lock Position 9) securing the frame 1 in the open configuration and the structure of the tent.

Referring to FIG. 2, each slider 2 includes a release mechanism 7 to allow the folding or unfolding of the frame 1. Although, the release mechanism 7 is illustrated as a pull-ring, it is also envisaged that the release mechanism 7 may be a quick release button or the like.

Figure 3:
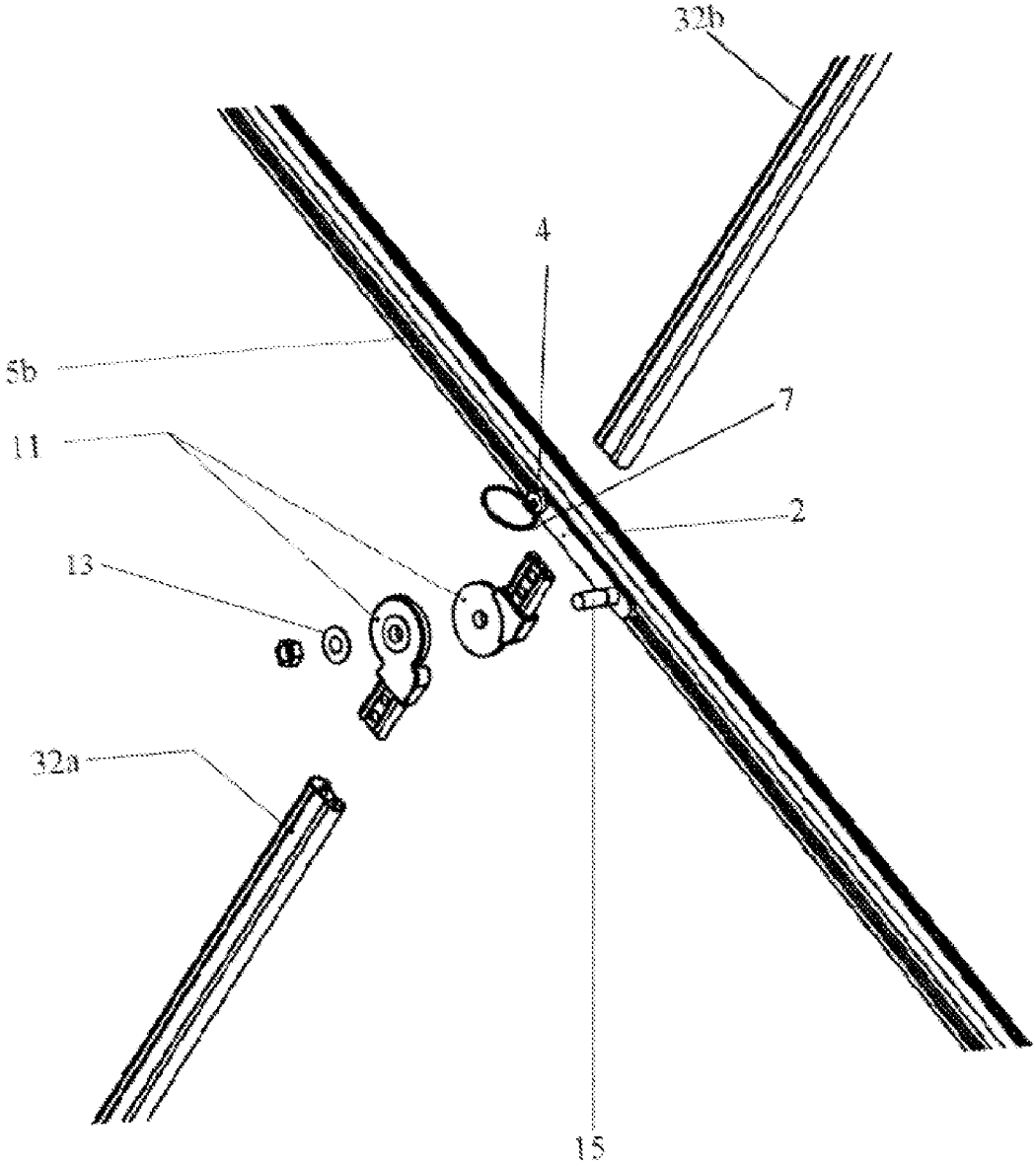
FIG. 3 is an exploded parts view of FIG. 2.

Referring to FIGS. 2 and 3, each slider 2 includes a hinge 11 that is pivotally coupled to a pivot pin 15 of a respective slider 2. The hinge 11 can be of circular shape as illustrated and include an M8 nut and washer 13 or the like. The washer 13 is adapted to be received by the pivot pin 15 of a respective slider 2 and the M8 nut is adapted to removably engage the pivot pin 15 to retain the hinge 11 on the respective slider 2.

The self-locking slider 2 locks into position one (Stop Position 8) thus not requiring the user to stretch across and push the slider 2 into the fixed position thus making set-up a true one person operation for all consumers. Further, the slider 2 can then be slid into the Lock Position 9 securing the frame 1 and structure of the tent.

Figure 4:
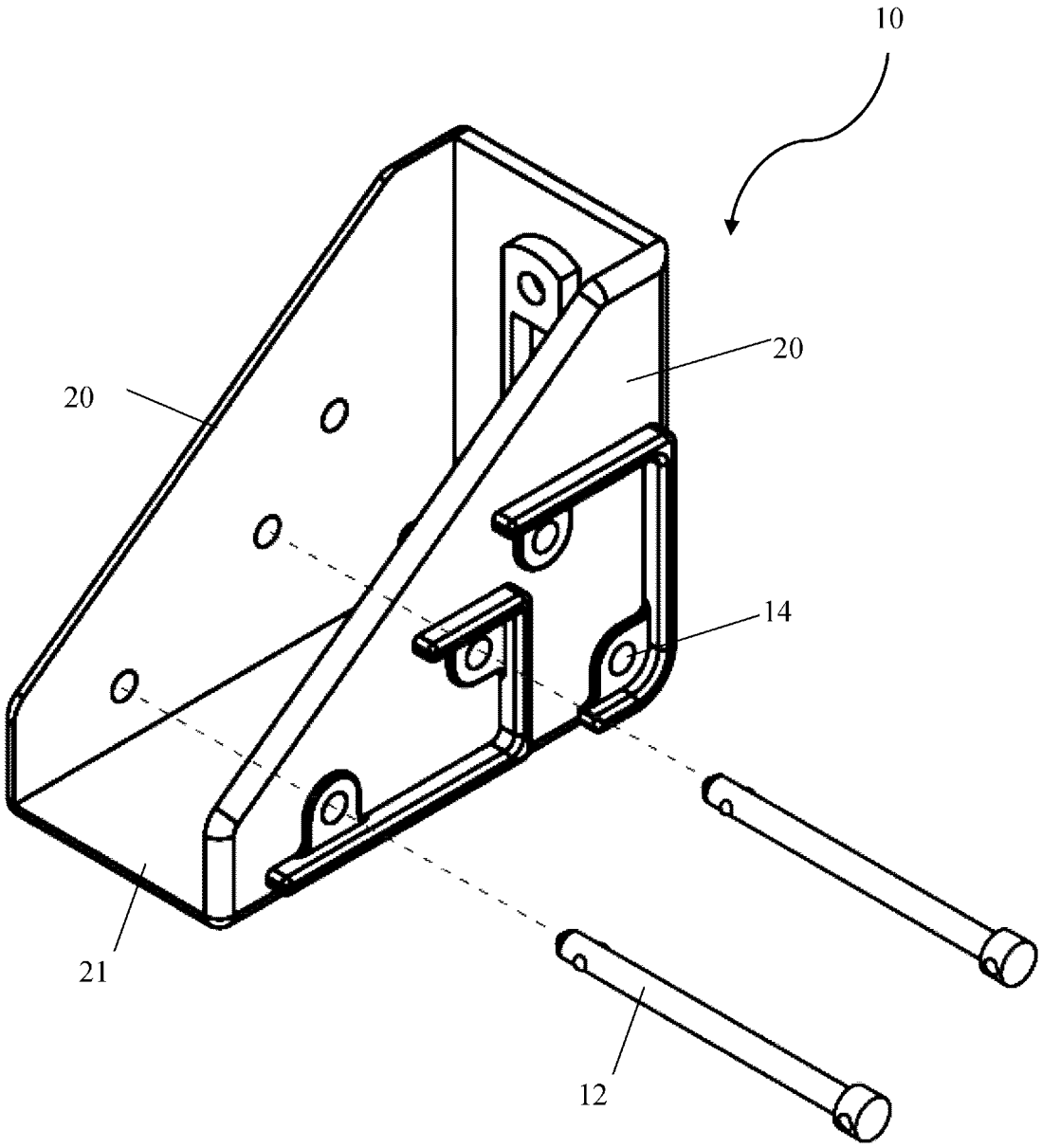
FIG. 4 is a perspective view of a foot of the tent frame of FIG. 1.
Figure 5:
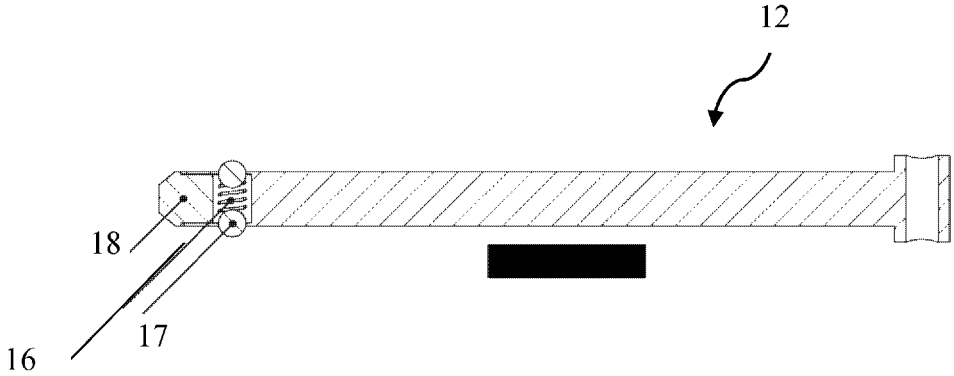
FIG. 5 is a side view a locking fixing pin of the foot of FIG. 4.

Referring to FIGS. 4 and 5, the frame 1 also includes two quick release feet 10 that are adapted to be placed on a surface to support the frame 1 in use. Referring to FIG. 1, one foot 10 is coupled to each of the first free ends 4*a-c* of the sub-frames 3*a-c* and the other foot 10 is coupled to each of the second free ends 6*a-c* of the sub-frames 3*a-c*.

Referring to FIGS. 4 and 5, each foot 10 use easily removable self-locking fixing pins 12 instead of rivets and/or bolts that lock into holes 14 of a respective foot 10, thereby allowing the feet 10 to be removed from the frame 1. Referring to FIG. 5, each fixing pin 12 includes a spring 16, ball bearings 17, and a cap 18. As can be seen from FIG. 5, the spring 16 biases the ball bearings outwardly such that each ball bearing 17 protrudes from the fixing pin 12. It will be appreciated that when the ball bearings 16 protrude from the fixing pin 12, the pin 12 will be retained in a respective one of the holes 14 of the foot 10. It will also be appreciated that forcing the ball bearings 16 inwardly into the fixing pin 12 allows the fixing pin 12 to be withdrawn from a respective one of the holes 14 of the foot 10.

Referring to FIG. 4, each foot 10 in one embodiment is of a generally U-shape having a pair of sides 20 and a base 21 extending between the pair of sides 20. Each of the side members 5*c* of sub-frame 3*c* (i.e. the sub-frame that in use is located on the ground surface) are received between the pair of sides 20 and coupled to the base 21 of one of the feet 10. Each of the side members 5*a, b* of sub-frames 3*a, b* are received between, and coupled to, the pair of sides 20 of one of the feet 10 by at least one fixing pin 12 extending through respective holes 14 of the foot 10. When each side member 5*a, b* is coupled to one of the feet 10 by one fixing pin 12, the sub-frames 3*a, b* are able to rotate with respect to the feet 10, thereby allowing the frame 1 to move between the open and closed configurations. When each side member 5*a, b* is coupled to one of the feet 10 by at least two fixing pins 12, the frame 1 is able be locked in the open configuration or the closed configuration.

The feet 10 are adapted to be easily replaceable if damaged or can be changed depending upon the surface the tent is to rest on. For example, it can include a rubber base, spikes or the like depending upon the surface.

Referring to FIG. 1, the frame 1 also has corner pieces 23 where required. The corner pieces 23 allow each cross member 35*a-c* to be coupled to respective side members 5*a-c*. The corner pieces 23 may also be a hinge to allow the respective cross member 35*a-c* and the respective side member 5*a-c* that are connected to the corner piece 23 to be placed at right angles to each other when the frame 1 is in the open configuration and to be located substantially parallel to each other when the frame 1 is in the closed configuration.

Referring to FIG. 1, the frame 1 also includes support members 30*a*, 30*b*, which are adapted to support the frame 1 in the open configuration. Referring to FIGS. 2 and 3, each support is composed of two members 32*a*, 32*b*, which are coupled to a respective hinge 11. In the open configuration, each hinge 11 is in a locked position and the respective support members 30*a*, 30*b* extend between respective side members 5*a, c*, are substantially straight, and adapted to support the frame 1. Each hinge 11 allows the respective support member 30*a*, 30*b* to fold about the hinge 11 when moving the frame 1 between the open and closed configurations. Each support member 30*a*, 30*b* is coupled to one of the respective side members 5*b* via respective hinges 11 and sliders 2.

Figure 6:
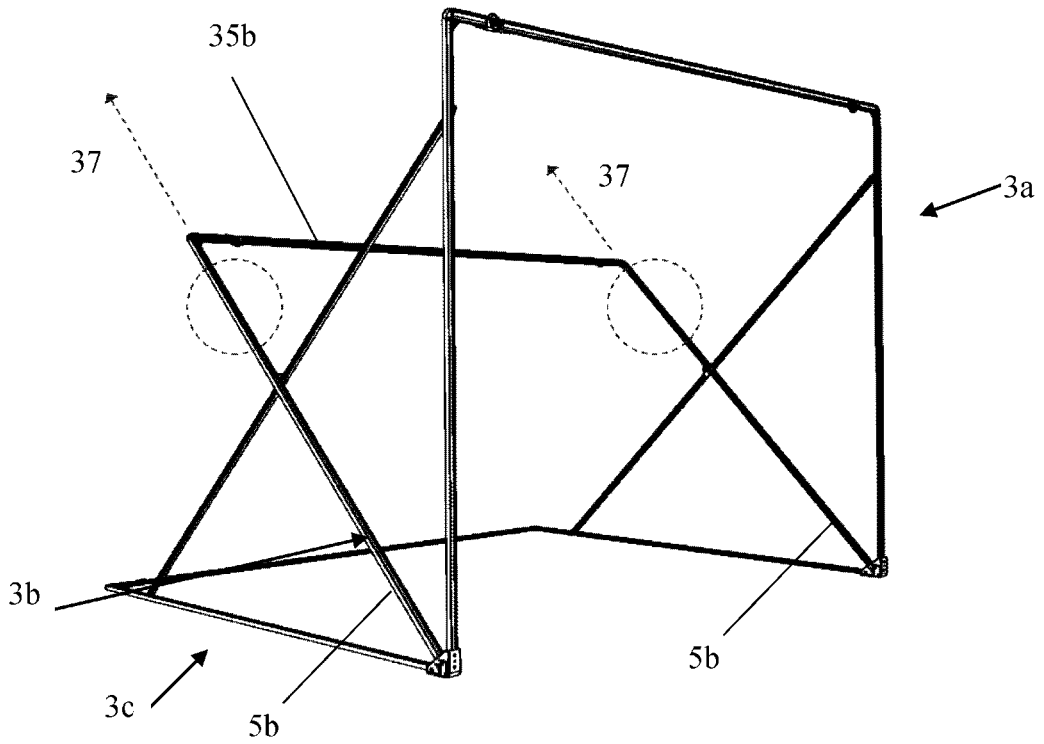
FIG. 6 shows the telescopic extension of the tent frame of FIG. 1.
Figure 7:
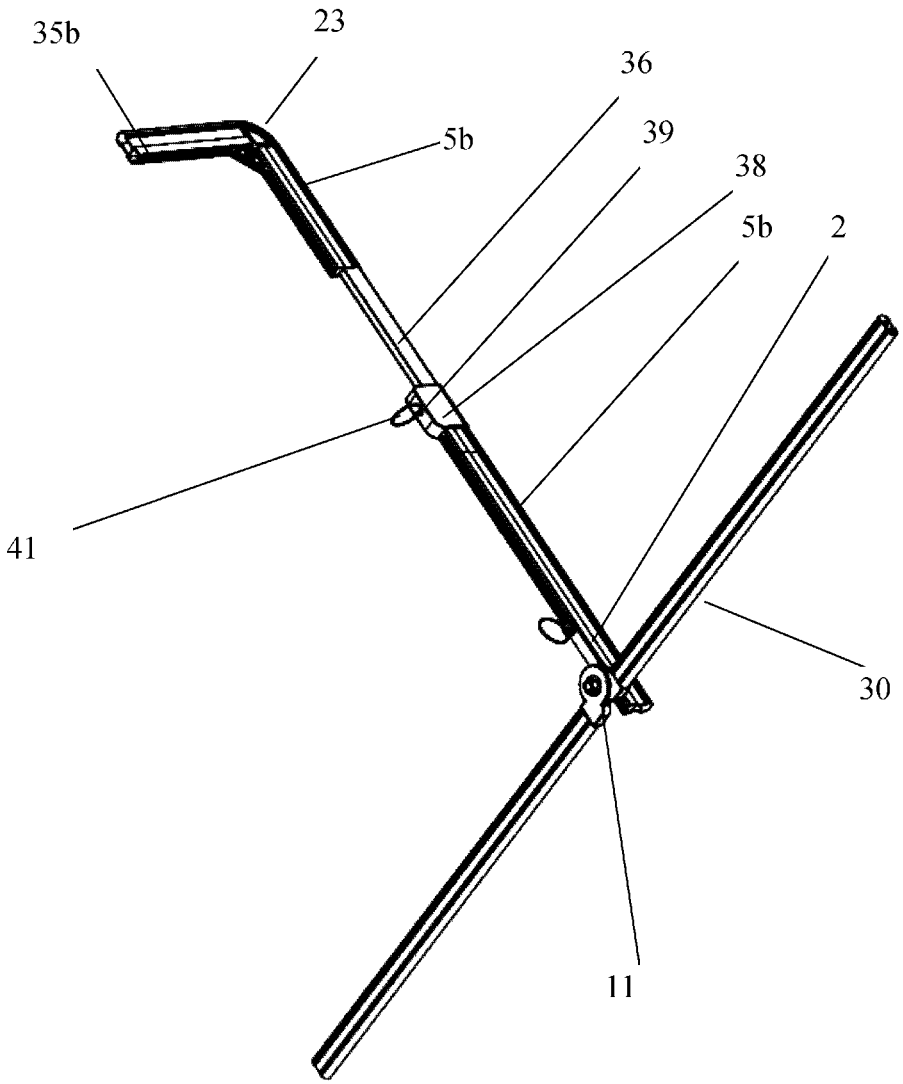
FIG. 7 is an enlarged partial view of the telescopic extension of the tent frame of FIG. 1.
Figure 8:
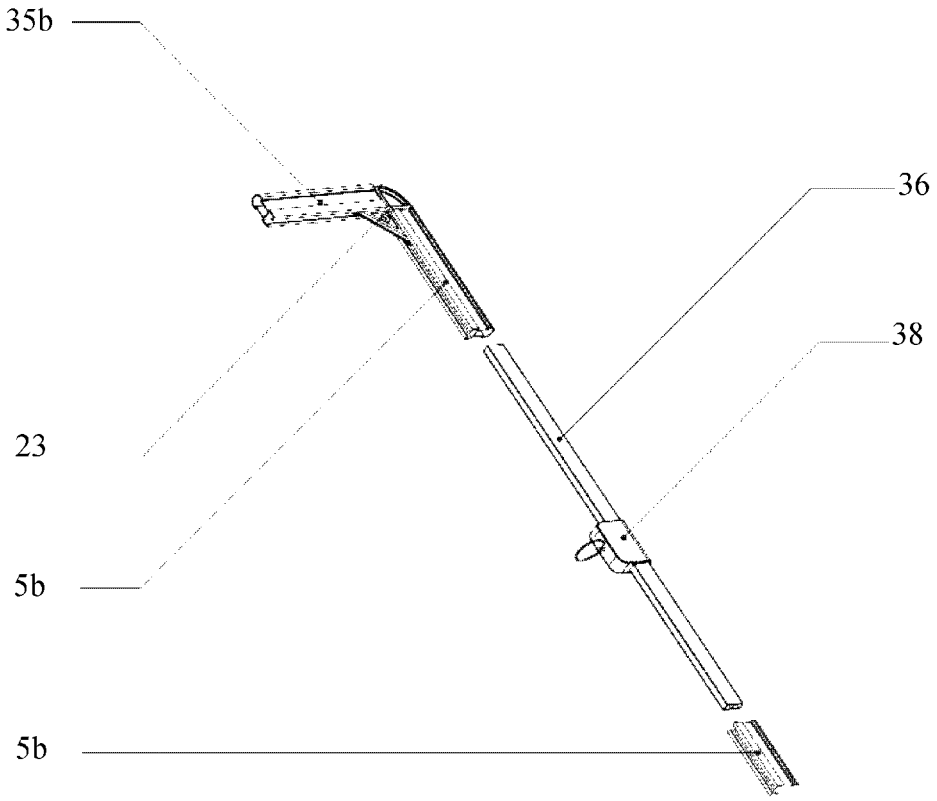
FIG. 8 is an exploded parts view of the telescopic extension of FIG. 7.
Figure 9:
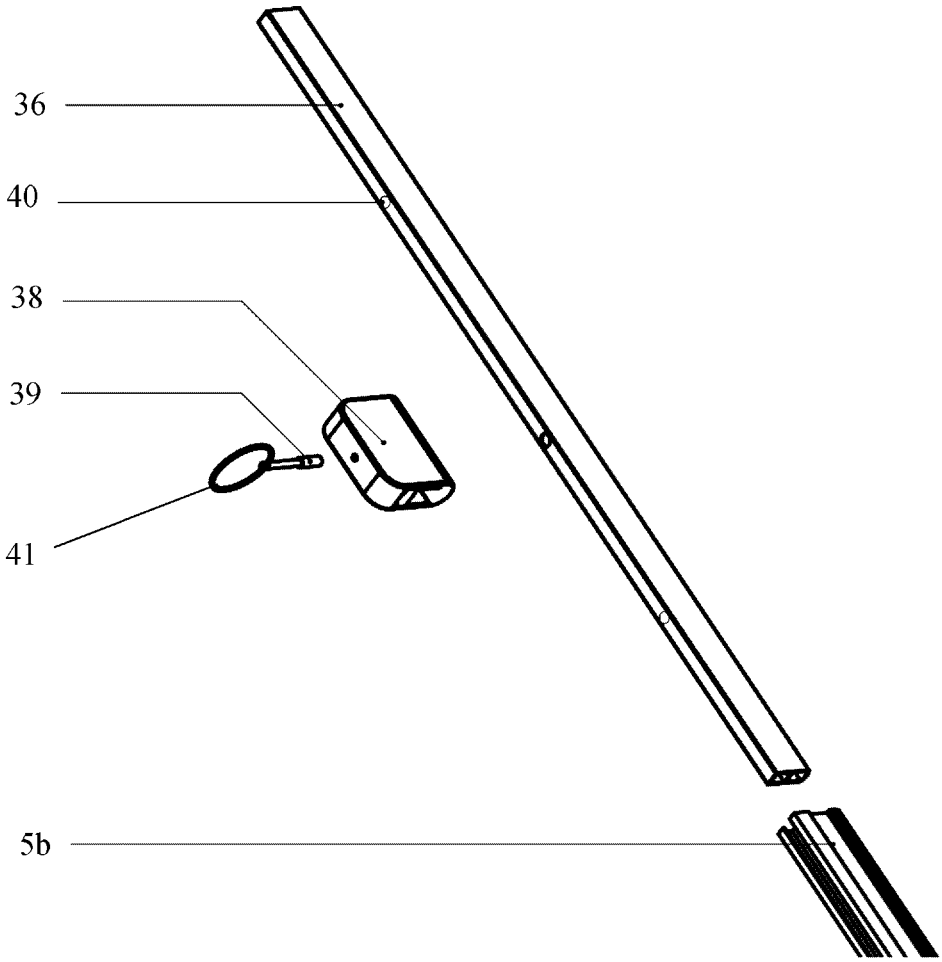
FIG. 9 is another exploded parts view of the telescopic extension of FIG. 7.

Referring to FIGS. 6 to 9, side members 5*b* include a telescopic extension 36 that allow the cross member 35*b* to move from the position illustrated in FIG. 6 in a direction along the arrows 37, thereby increasing the length of the sub frame 3*b*. It will therefore be appreciated that the length of the sub frame 3*b* may be increased and decreased, which will therefore increase and decrease the height the tent when the cover is coupled to the frame 1. Each telescopic extension 36 contains a slider 38 that is adapted to slide along one of the telescopic extensions 36. The sliders 38 are similar to the sliders 2 discussed above, but do not have a pivot pin 15 or a hinge 11. Each slider 38 has a pin 39 that can lock into holes 40 of a respective telescopic extension 36 to lock the slider 38 with respect to the telescopic extension 36 at one, two or more locations along the telescopic extension 36. Each slider 38 includes a release mechanism 41 to increase and decrease the length of the side members 5*b*. Although, the release mechanism 41 is illustrated as a pull-ring, it is also envisaged that the release mechanism 41 may be a quick release button.

The frame 1 is modular and adapted to connect to other frames 1 on each side so as to extend the useable surface area.

Figure 10:
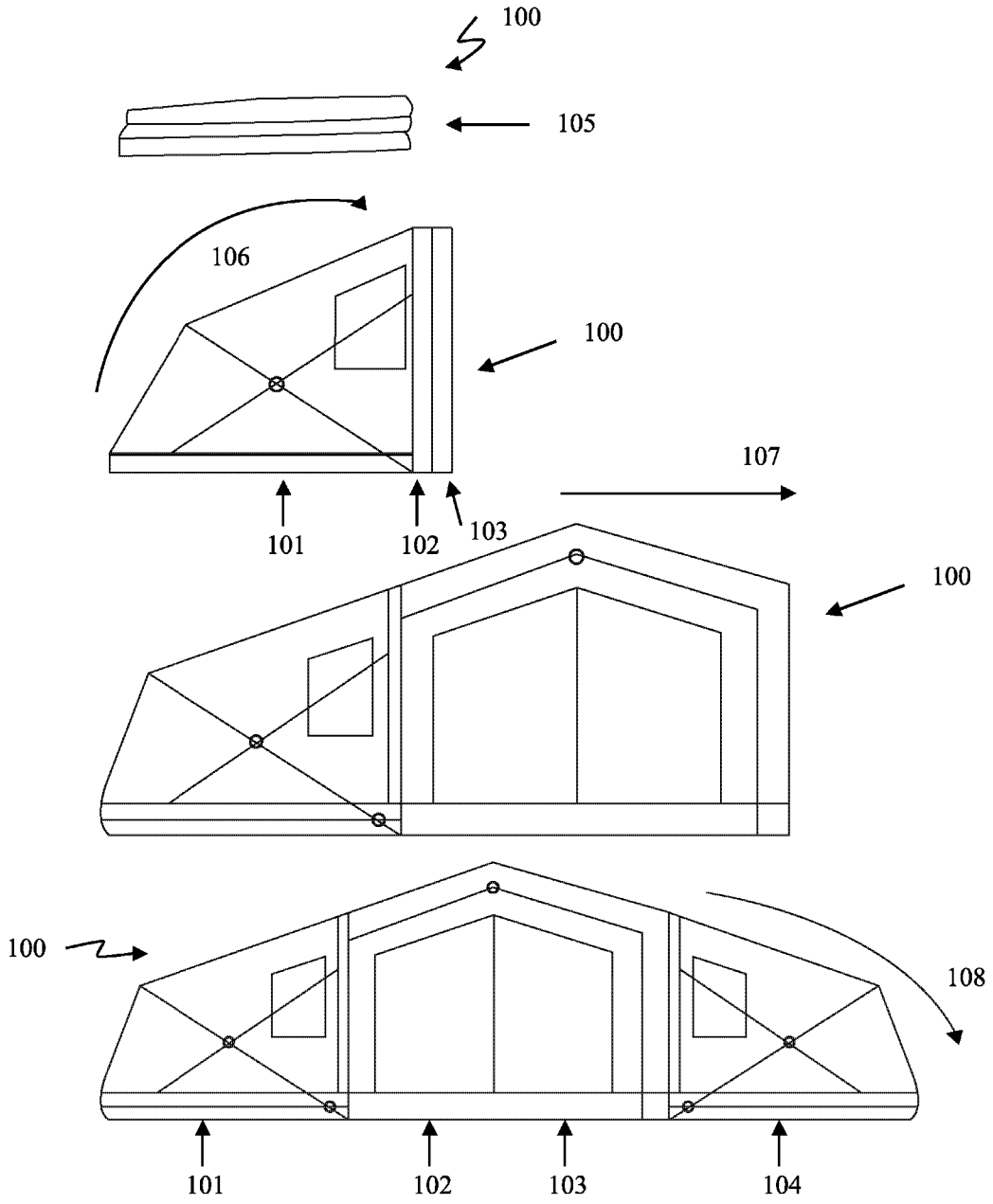
FIG. 10 shows a further tent of an embodiment of the present invention.

As shown in FIG. 10, the tent 100 starts in a flat pack arrangement and uses a concertina style folding mechanism that enables the size of fold out sections 101, 102, 103, 104 to be increased beyond their normal fixed arrangement. This involves from a flat pack 105, fold out 106, slide out 107, fold down 108 sections.

In other embodiments, the quick release foot 10 can be serviced in the field making repair and maintenance simple and effective. The size of fold out tent sections 101, 102, 103, 104 can be dramatically increased without over complicating set-up and pull-down by way of the telescopic extrusions. The overall height of the fold out tent can be increased to full height for most customers significantly eliminating the need for poles, spreaders or ridge bars.

Significantly the invention herein makes it much easier and faster to erect the tent and in most cases reduces if not eliminates the need for poles, spreader poles and associated guy ropes.

Although the invention has been described with reference to specific examples, it will be appreciated by those skilled in the art that the invention may be embodied in many other forms.

The invention claimed is:

1. A tent having a frame, the frame having:

a plurality of sub-frames;

each said sub-frame having a pair of elongate side members connected by an elongate cross member, a first free end, and a second free end;

a first foot coupled to each of said first free ends of said sub-frames;

a second foot coupled to each of said second free ends of said sub-frames;

each foot adapted to permit movement of said sub-frames with respect to each other, and each foot adapted to be placed on a surface to support said frame in use;

wherein a first sub-frame of the plurality of sub-frames is adapted to be located in use on a ground surface, wherein the tent further includes a locking mechanism locatable on a second sub-frame of the plurality of sub-frames and adapted in use to slide along a respective-one of said pair of side members of said second sub-frame to lock in place a support member extendable in use from said first sub-frame, and wherein said locking mechanism is selectively lockable at one of a plurality of discrete locking positions along said respective one of said pair of side members of said second sub-frame; and wherein said locking mechanism includes a slider, the slider having a first pin spaced from a second pin, said first pin adapted in use to lock into said respective one of said pair of side members of said second sub-frame, and wherein said slider further includes a hinge pivotally coupled to said second pin to allow said support member to pivot with respect to said respective one of said pair of side members of said second sub-frame.

2. The tent of claim 1, wherein said sub-frames are n-shaped.

3. The tent of claim 1, wherein said side members are telescopically extendable members.

4. The tent of claim 1, wherein said cross members are telescopically extendable members and provide stability between said sub-frames.

5. The tent of claim 4, wherein said side members and cross member of said second sub-frame are adapted to fold relative to said side members and cross member of said first sub-frame so that said side members and cross members of said first and second sub-frames are respectively substantially parallel to each other when the frame is in a closed configuration.

6. The tent of claim 1, wherein the frame, in an opened configuration, is adapted to hold a tent cover fixed to said frame by fasteners.

7. The tent of claim 6, wherein said side members and cross member are connected by a hinge adapted to permit said side members and cross members in the opened configuration to be placed at tight angles to each other and in a closed configuration to be locatable substantially parallel to each other.

8. The tent of claim 1, wherein the frame in use is modular and adapted to connect to other frames on each side to extend a useable surface area.

9. The tent of claim 1, wherein the slider includes a quick release button.

10. The tent of claim 1, wherein in use one or more of said sub-frames can be rotated away from the first sub-frame located in use on the ground surface to increase a volume of said tent.

11. The tent of claim 1, wherein the frame includes extension members to support a tent cover as said sub-frames are rotated away from said first sub-frame located in use on the ground surface.

12. The tent of claim 1, wherein each foot of the frame is removably coupled to said frame.

13. The tent of claim 1, wherein each foot comprises a pair of sides and a base extending between said pair of sides, each side member of said first sub-frame adapted to be located in use on the ground surface is coupled to said base of a respective one of said feet, and each side member of the other sub-frames is coupled to said pair of sides of a respective one of said feet.

14. The tent of claim 13, wherein each side member is located between said pair of sides of a respective one of said feet.

15. The tent of claim 1, further including a second locking mechanism locatable on said second sub-frame of the plurality of sub-frames and adapted in use to slide along the other of said pair of said side members of said second sub-frame to lock in place another support member extendable in use from said first sub-frame.

16. The tent of claim 1, wherein the first pin of the slider extends in a first direction and the second pin of the slider extends in a second direction opposite to the first direction.

17. The tent of claim 1, wherein said first pin is located at a first end of said slider and said second pin is located at a second end of said slider.

18. The tent of claim 1, wherein said second pin is a pivot pin.

* * * * *